US008414323B2

(12) United States Patent
Yu et al.

(10) Patent No.: US 8,414,323 B2
(45) Date of Patent: Apr. 9, 2013

(54) POWER CONNECTOR

(75) Inventors: Wang-I Yu, Jhonghe (TW); Hung-Chi Tai, Johnghe (TW); Zhi-Qiang Rong, Taicang (CN)

(73) Assignee: Alltop Electronics (Suzhou) Co., Ltd., Taicang (CN)

( * ) Notice: Subject to any disclaimer, the term of this patent is extended or adjusted under 35 U.S.C. 154(b) by 30 days.

(21) Appl. No.: 13/109,608

(22) Filed: May 17, 2011

(65) Prior Publication Data

US 2012/0252253 A1 Oct. 4, 2012

(30) Foreign Application Priority Data

Mar. 30, 2011 (CN) ..... 2011 1 0078717

(51) Int. Cl.
*H01R 13/648* (2006.01)

(52) U.S. Cl. ..... 439/345

(58) Field of Classification Search ..... 439/345, 439/357, 839, 825, 701, 660, 746, 395
See application file for complete search history.

(56) References Cited

U.S. PATENT DOCUMENTS 4,540,235 A * 9/1985 Lolic ..... 439/839
4,840,578 A * 6/1989 Sato ..... 439/395
5,951,336 A * 9/1999 Seko et al. ..... 439/745
6,116,931 A * 9/2000 McCleerey et al. ..... 439/173
6,905,373 B2 * 6/2005 Wu ..... 439/746
7,112,105 B2 * 9/2006 Wu ..... 439/752.5
D555,092 S * 11/2007 Li et al. ..... D13/133
7,641,500 B2 * 1/2010 Stoner et al. ..... 439/357
7,780,489 B2 * 8/2010 Stuklek ..... 439/825
7,922,520 B2 * 4/2011 Mizukami ..... 439/493
7,955,137 B2 * 6/2011 Ko et al. ..... 439/660
8,062,075 B2 * 11/2011 Huang ..... 439/701
8,142,226 B2 * 3/2012 Xiao et al. ..... 439/607.56
8,174,847 B2 * 5/2012 Ohtsuji et al. ..... 361/818
2010/0158449 A1 * 6/2010 Yi ..... 385/75

* cited by examiner

*Primary Examiner* — Alexander Gilman
(74) *Attorney, Agent, or Firm* — Sughrue Mion, PLLC

(57) ABSTRACT

A power connector, adapted for electrically connecting a cable with a complementary connector, includes an insulative housing defining a number of passageways and a number of power contacts received in corresponding passageway. Each contact has a base section, a first contact section and a second contact section. The base section includes a bottom wall and a first side wall and a second side wall extending perpendicularly from the bottom wall. The first contact section includes a first contact arm and a second contact arm parallel to the first contact arm. The second contact section includes a third contact arm and a fourth contact arm parallel to the third contact arm.

20 Claims, 13 Drawing Sheets

POWER CONNECTOR

BACKGROUND OF THE INVENTION

1. Field of the Invention

The present invention relates to a power connector, more particularly to a power connector connecting with a cable.

2. Description of Related Art

Power connectors are widely used today. In general, power connectors can be classified into personal use and industrial use. When in personal use, power connectors can be classified as desktop connectors, laptop connectors, mobile phone connectors, consuming connectors, and other types. Conventionally, a power connector comprises an insulative housing, a plurality of power contacts contained in the insulative housing, and a metal shell. Usually, the power contact is configured with a contact portion, a cable connecting portion and an intermediate portion connecting the contact portion and the cable connecting portion. In most cases, the power contact will be manufactured by soldering several pieces of elements together. Obviously, such a power contact results in high produce cost.

Hence, it is desirable to design a power connector to address problem mentioned above.

BRIEF SUMMARY OF THE INVENTION

Accordingly, an object of the present invention is to provide a power connector with improved power contact structure.

In order to achieve the above-mentioned object, a power connector, adapted for electrically connecting a cable with a complementary connector, includes an insulative housing defining a number of passageways and a number of power contacts received in corresponding passageway. Each contact has a base section, a first contact section and a second contact section. The base section includes a bottom wall and a first side wall and a second side wall extending perpendicularly from the bottom wall. The first contact section includes a first contact arm and a second contact arm parallel to the first contact arm. The second contact section includes a third contact arm and a fourth contact arm parallel to the third contact arm.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
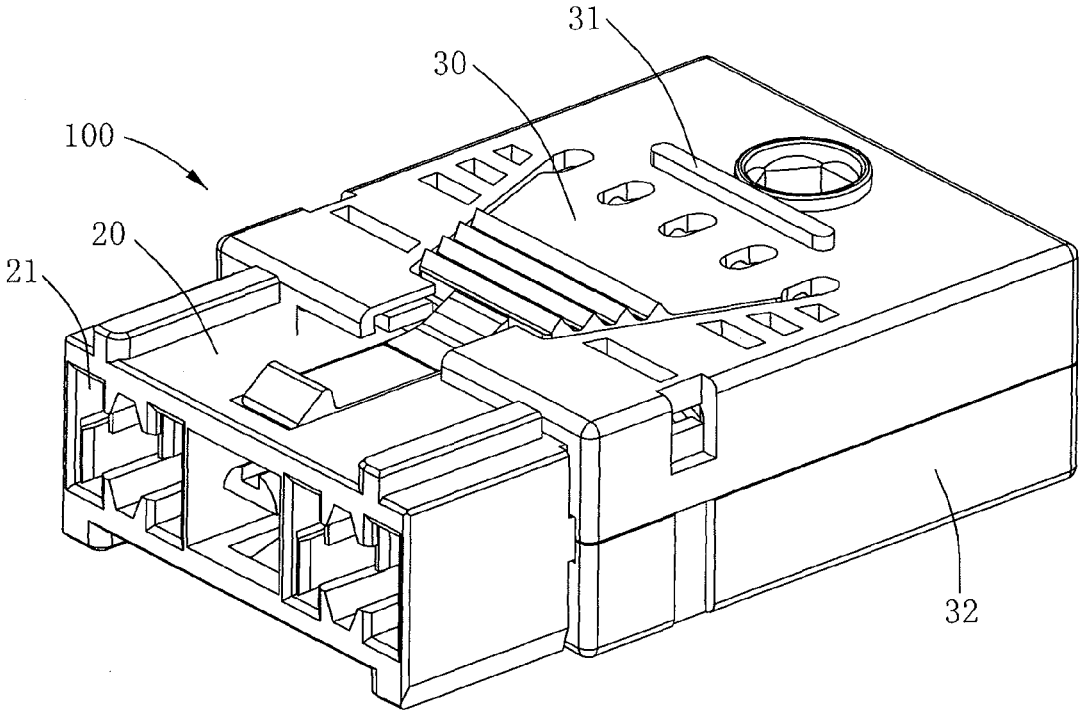
FIG. 1 is an assembled, perspective view of a power connector in accordance with the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
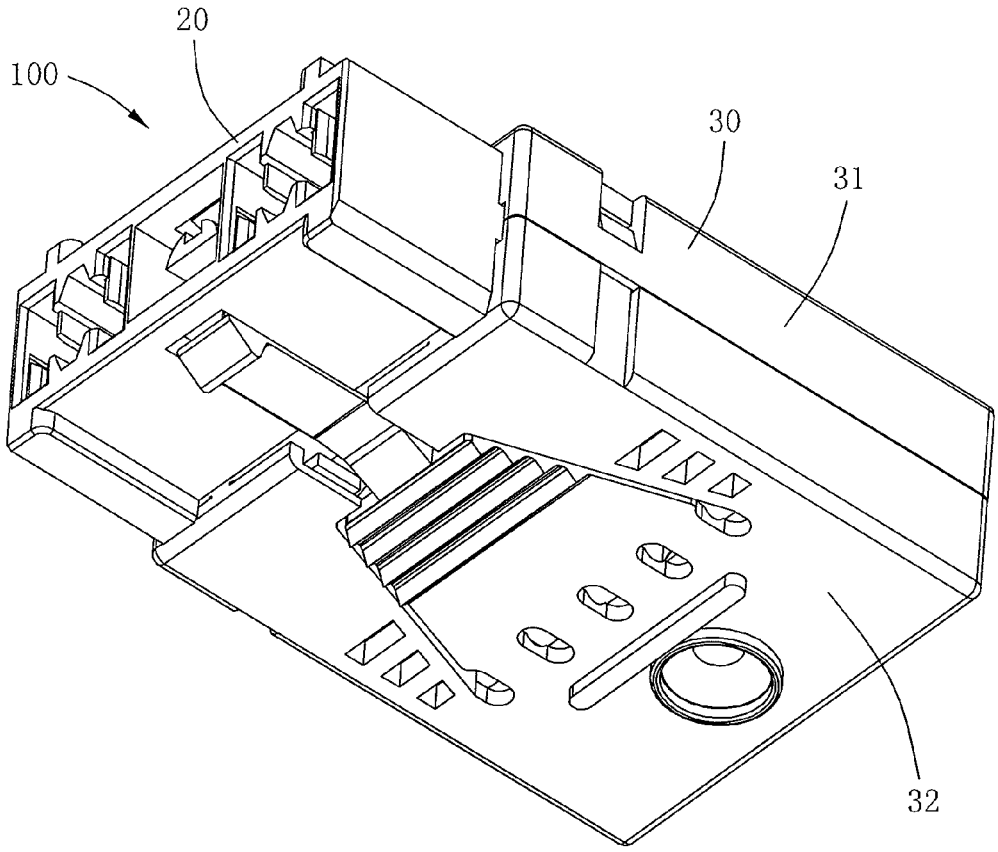
FIG. 2 is a view similar to FIG. 1 while taken from another aspect.
Figure 3:
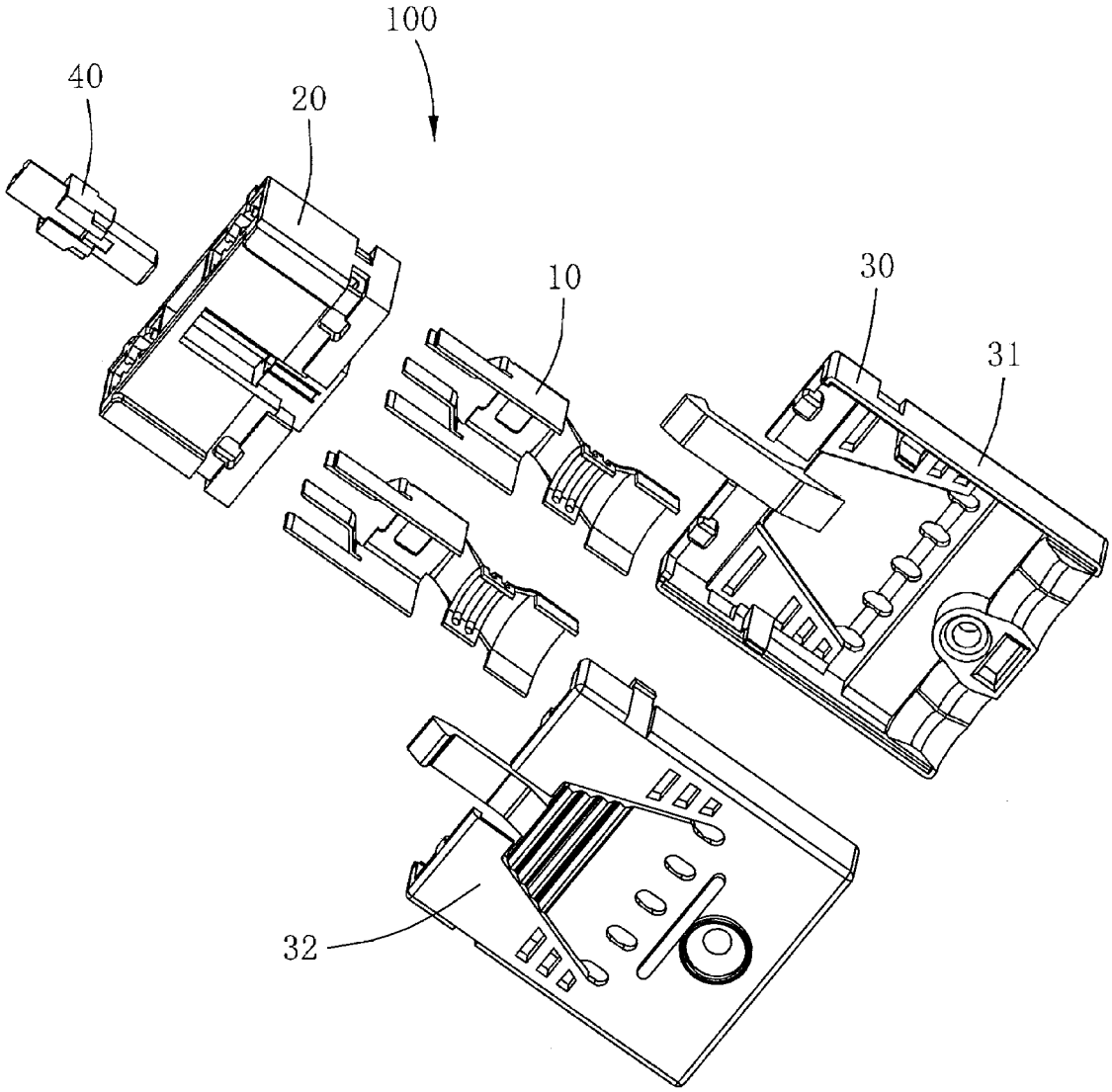
FIG. 3 is an explored, perspective view of the power connector shown in FIG. 1.

Referring to FIGS. 1-3, a power connector 100 in accordance with the present invention comprises a pair of power contacts 10, an insulative housing 20 receiving the power contacts 10, a metal shell 30 covering the insulative housing 20 and the power contacts 10, and an anti-misplugging element 40 assembled in the insulative housing 20. The power connector 100 of the present invention is adapted for connecting with a cable (not shown). Understandably, the number of the power contacts 10 in the present invention can be changed according to different environments.

Figure 4:
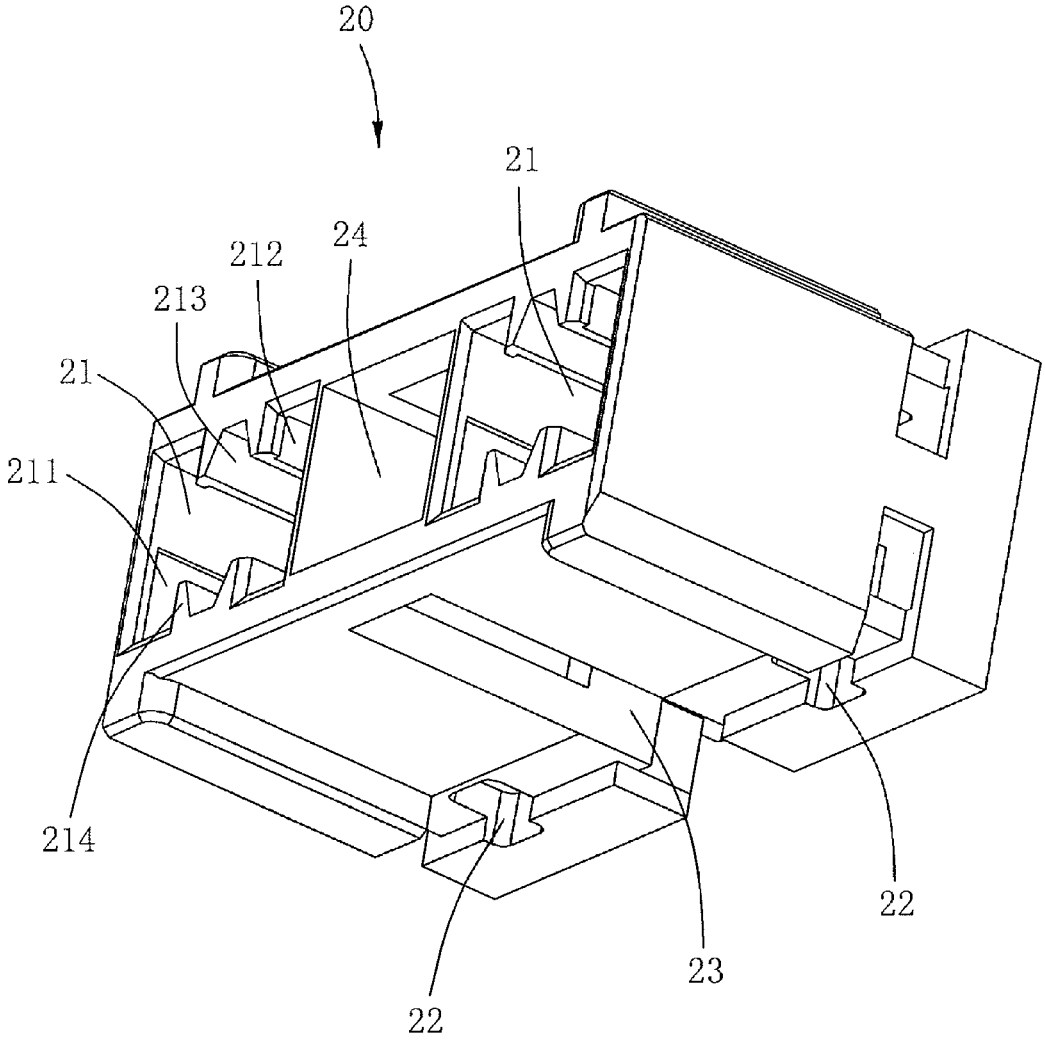
FIG. 4 is a perspective view of an insulative housing of the power connector shown in FIG. 1.
Figure 5:
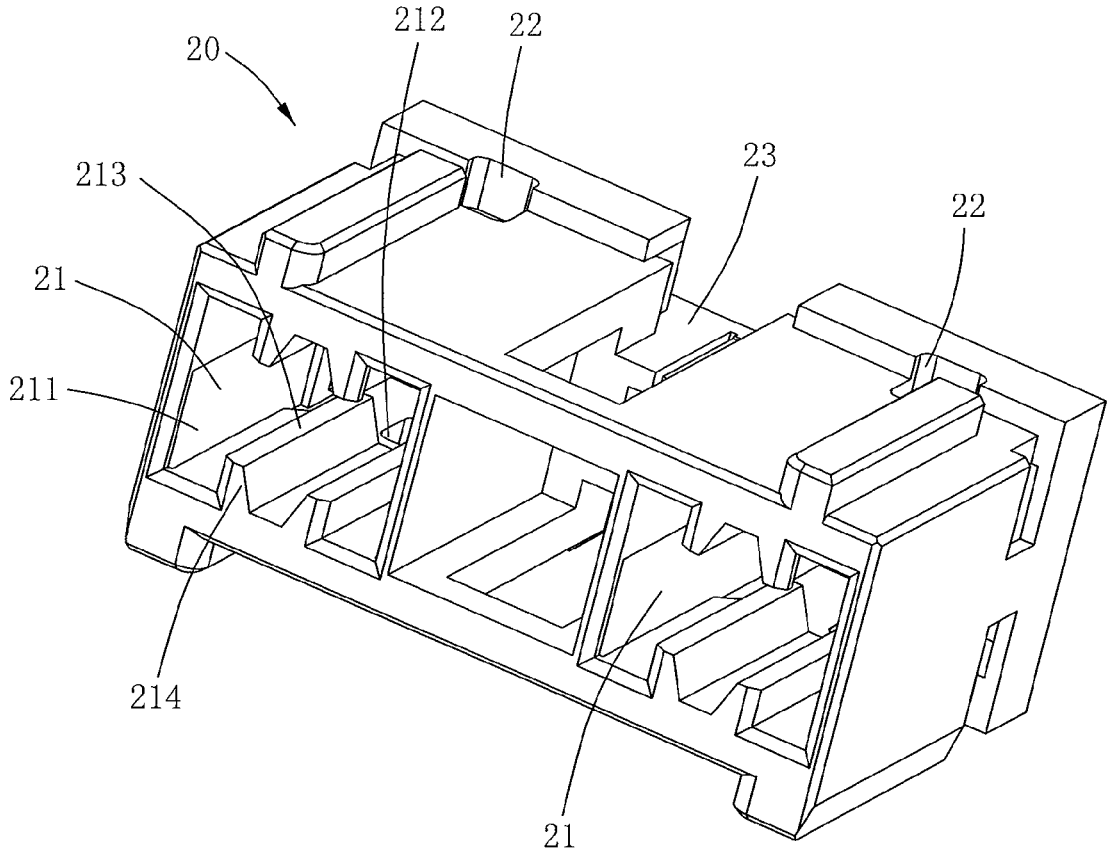
FIG. 5 a view similar to FIG. 4 while taken from another aspect.
Figure 6:
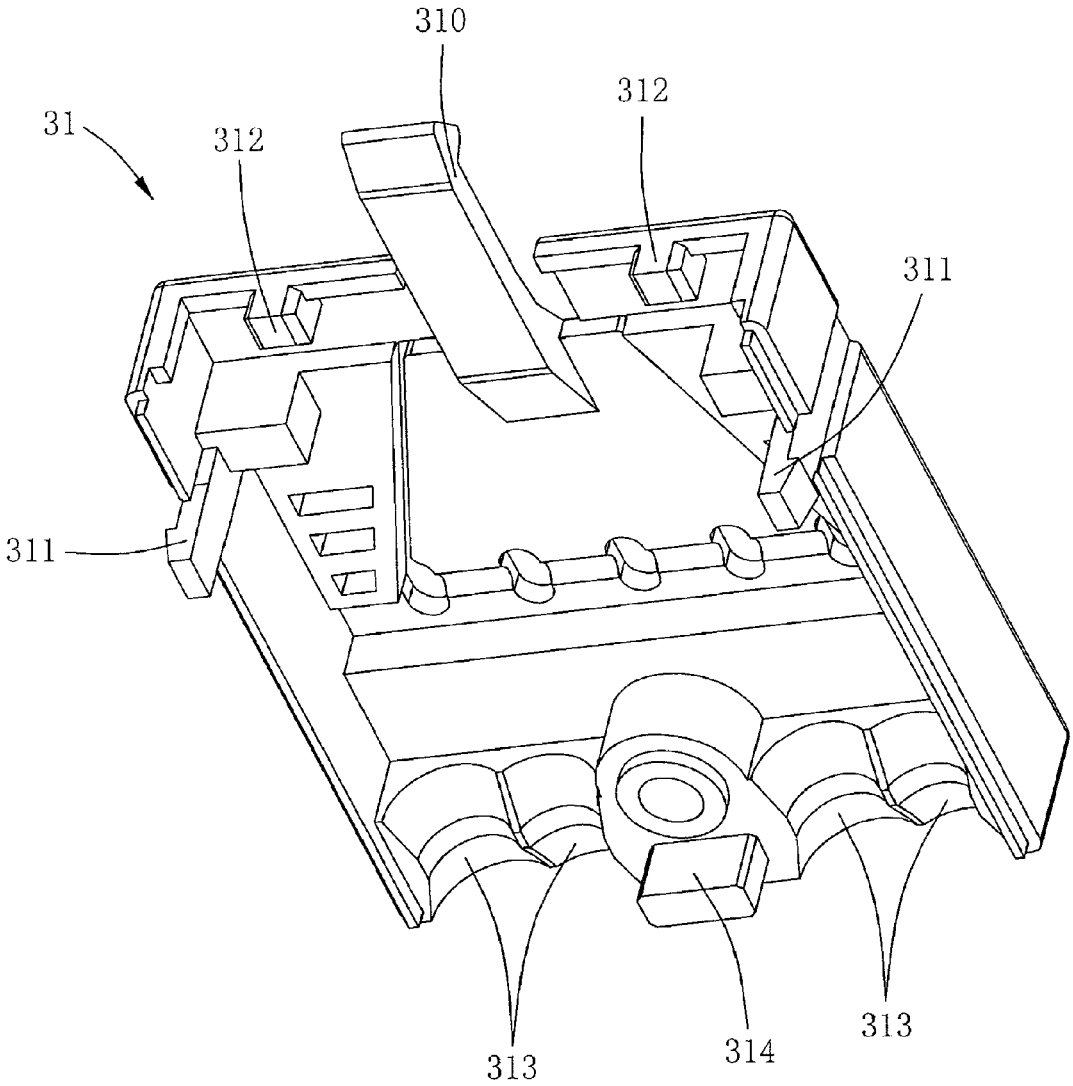
FIG. 6 is a perspective view of an upper shield of the power connector.
Figure 7:
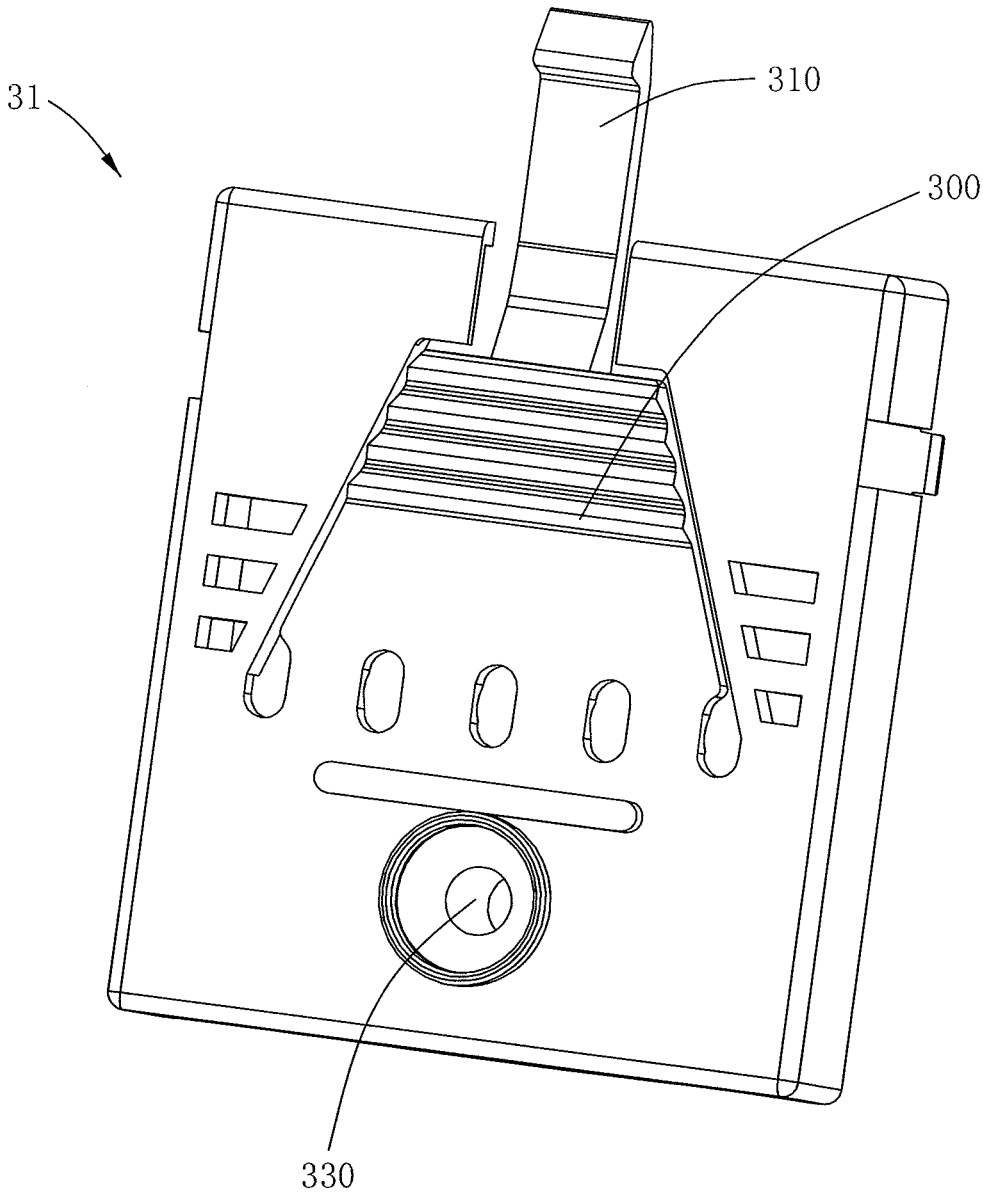
FIG. 7 is a view similar to FIG. 6 while taken from another aspect.
Figure 8:
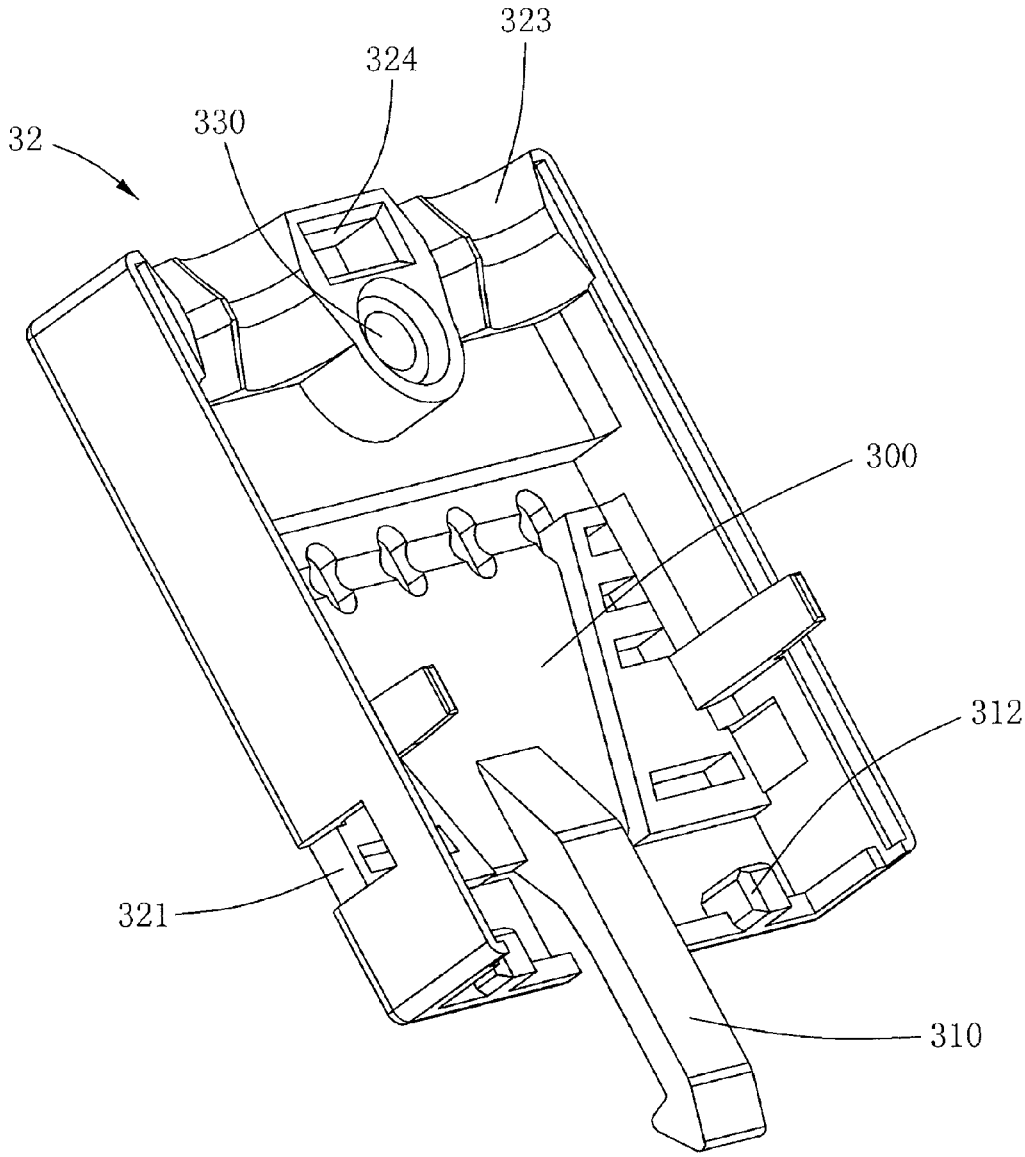
FIG. 8 is a perspective view of a lower shield of the power connector.
Figure 9:
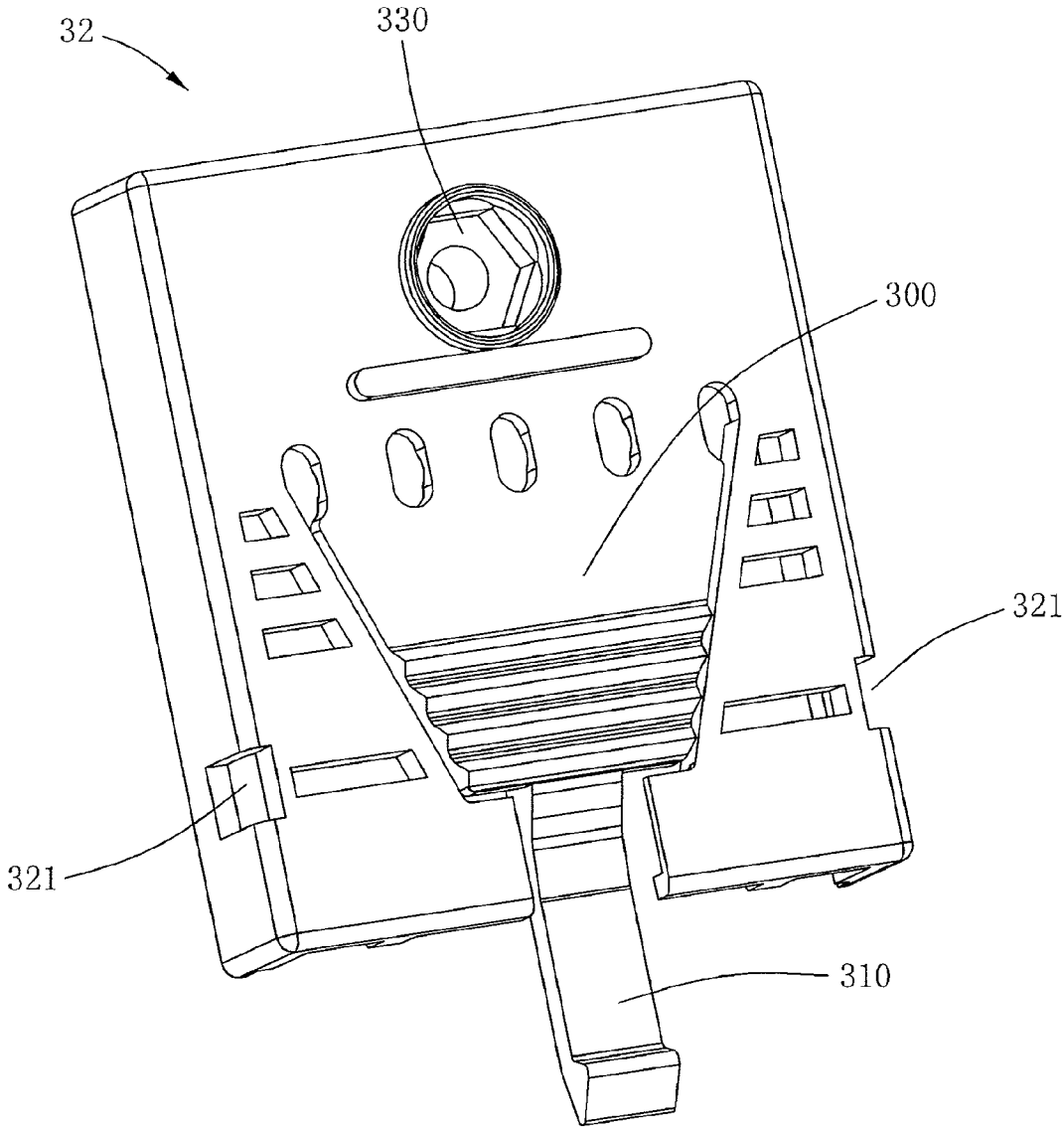
FIG. 9 is a view similar to FIG. 8 while taken from another aspect.

Please refer to FIGS. 4-5, the insulative housing 20 is elongated and defines a pair of passageways 21 extending therethrough for receiving corresponding contacts 10. Two pairs of grooves 22 are defined respectively on upper wall and lower wall (not labeled) of the insulative housing 20. A rectangular recess 23 is defined between the pair of the grooves 22 and extending along a direction which a complementary connector (not shown) is inserted. A key receiving hole 24 is defined between the pair of passageways 21 for receiving the anti-misplugging element 40 to thereby guiding the complementary connector correctly inserted into the power connector 100. The passageway 21 defines a first receiving passageway 211, a second receiving passageway 212 and a guiding slot 213 between the first and the second receiving passageways 211, 212. The guiding slot 213 communicates with the first and the second receiving passageways 211, 212 for heat-dissipation purpose. A plurality of projections 214 project within the passageway 21 and partially separate the two receiving passageways 211, 212 and the guiding slot 213.

Referring to FIGS. 6-9 together with FIG. 1, the metal shell 30 includes an upper shield 31 and a lower shield 32 capable of locking with the upper shield 31. A plurality of protrusions 312 are formed in inside walls of respective upper shield 31 and lower shield 32. When assembling the insulative housing 20 with the metal shell 30, the protrusions 312 can be engaged within the grooves 22 of the insulative housing 20. In the preferred embodiment, the upper shield 31 forms a pair of hook portions 311 on side walls (not labeled) which extend towards the insulative housing 20. The lower shield 32 defines a pair of cutouts 321 engaging with the hook portions 311 to thereby secure the upper shield 31 and the lower shield 32. Each of the upper shield 31 and the lower shield 32 provides a moveable latch 300. The moveable latch 300 forms a latch end 310 thereon. The latch end 310 can be received in the corresponding recess 23 of the insulative housing 20 to thereby lock with or unlock from the complementary connector.

Figure 12:
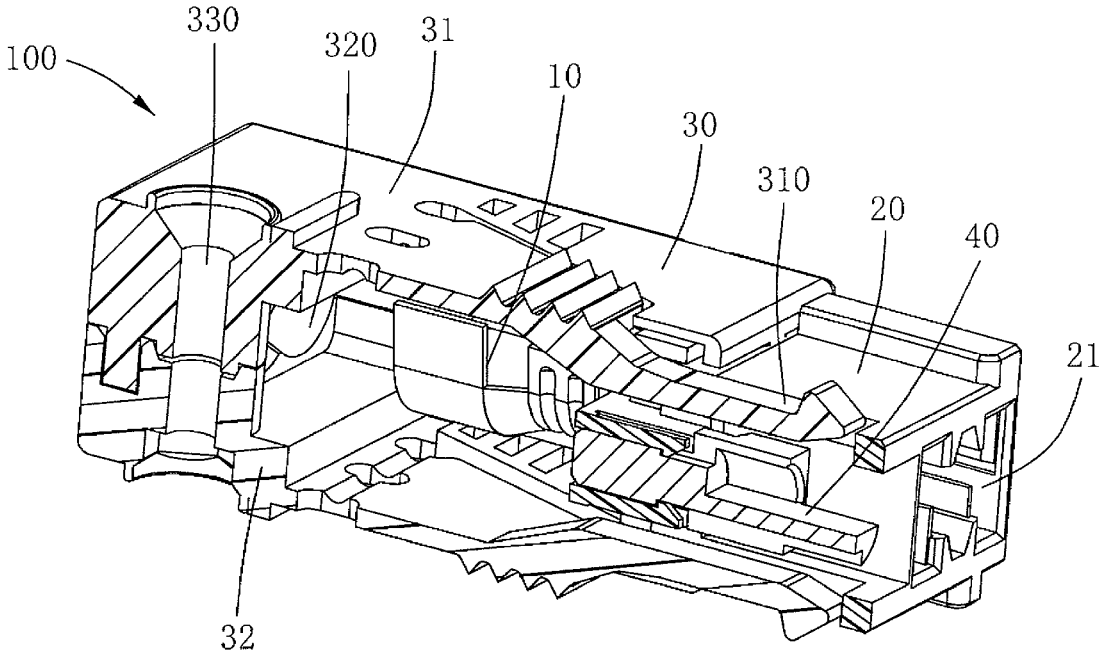
FIG. 12 is a perspective, cross-section view of the power connector.
Figure 13:
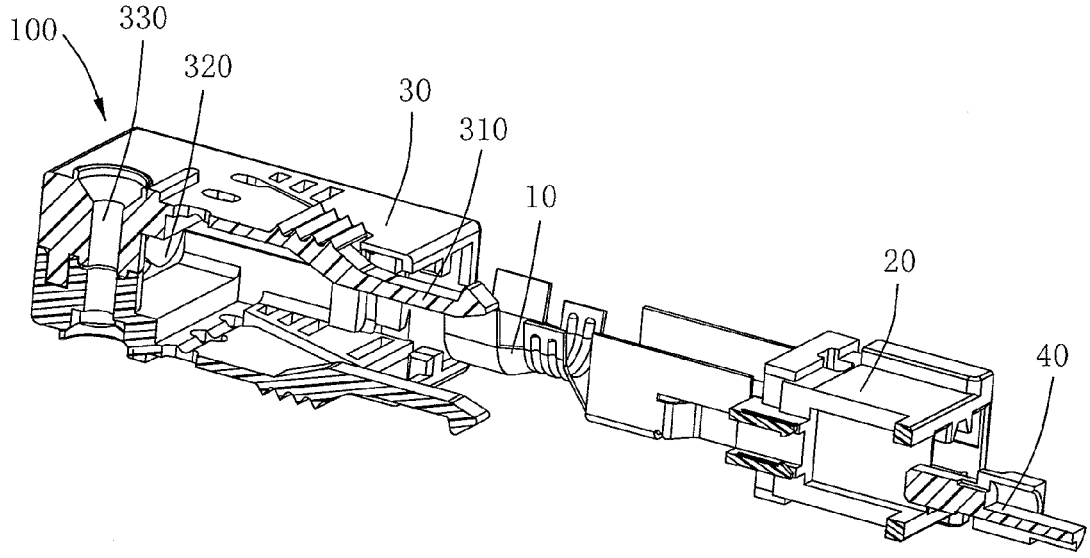
FIG. 13 is a partially, explored perspective, cross-section view of the power connector.

Please refer to FIGS. 6-9 together with FIG. 12, the upper shield 31 defines a pair of upper holes 313 and the lower shield 32 defines a pair of lower holes 323. The upper holes 313 and the lower holes 323 together defines a cable receiving hole 320 for receiving the cable. The metal shell 30 defines thereon a fastening hole 330 for a fastening element (not shown) inserting therethrough to thereby lock the upper and the lower shields 31, 32 together. In the preferred embodiment, the upper shield 31 provides a positioning pole 314 and the lower shield 32 provides a positioning hole 324 receiving the positioning pole 314.

Figure 10:
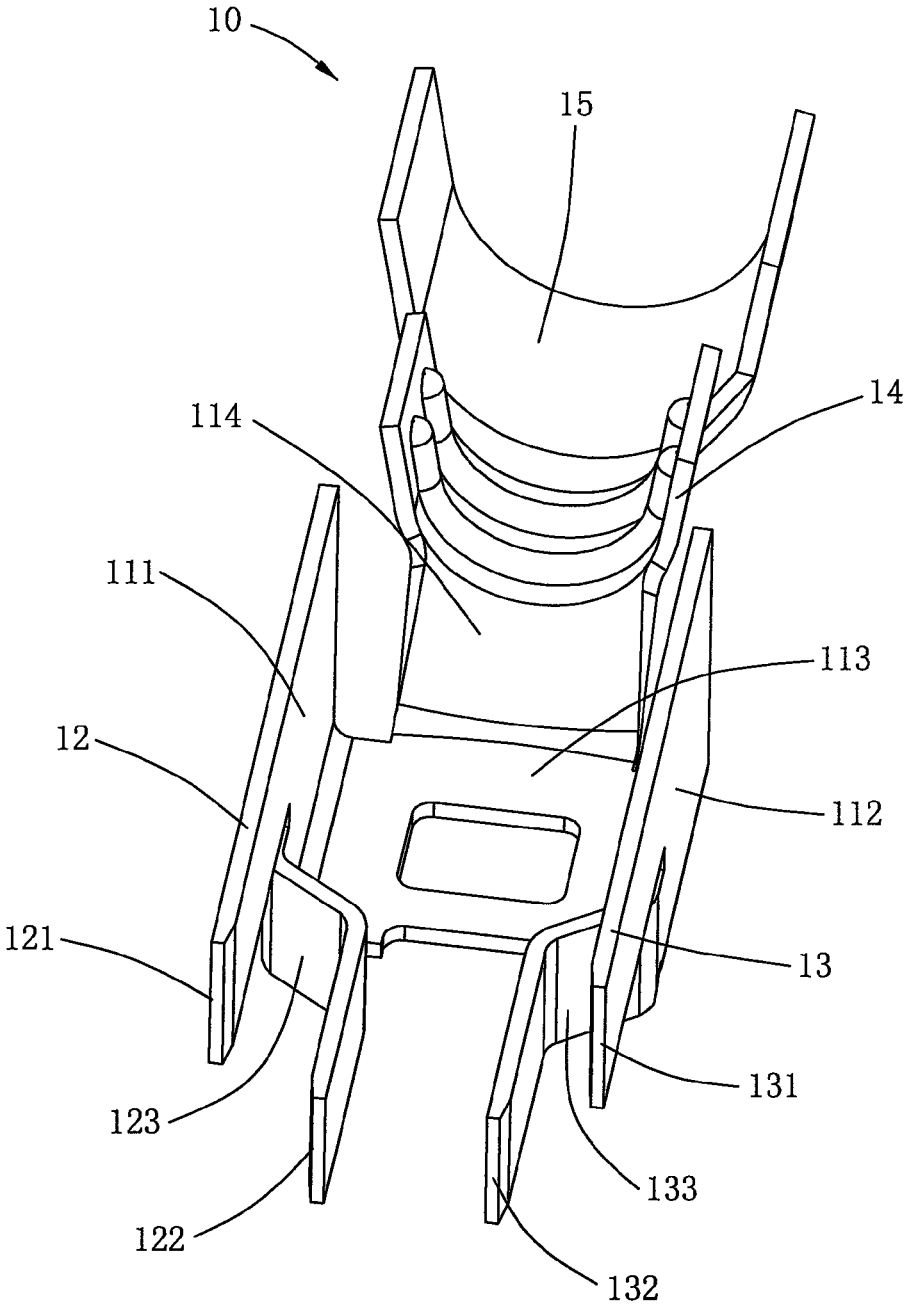
FIG. 10 is a perspective view of a power contact of the power connector.
Figure 11:
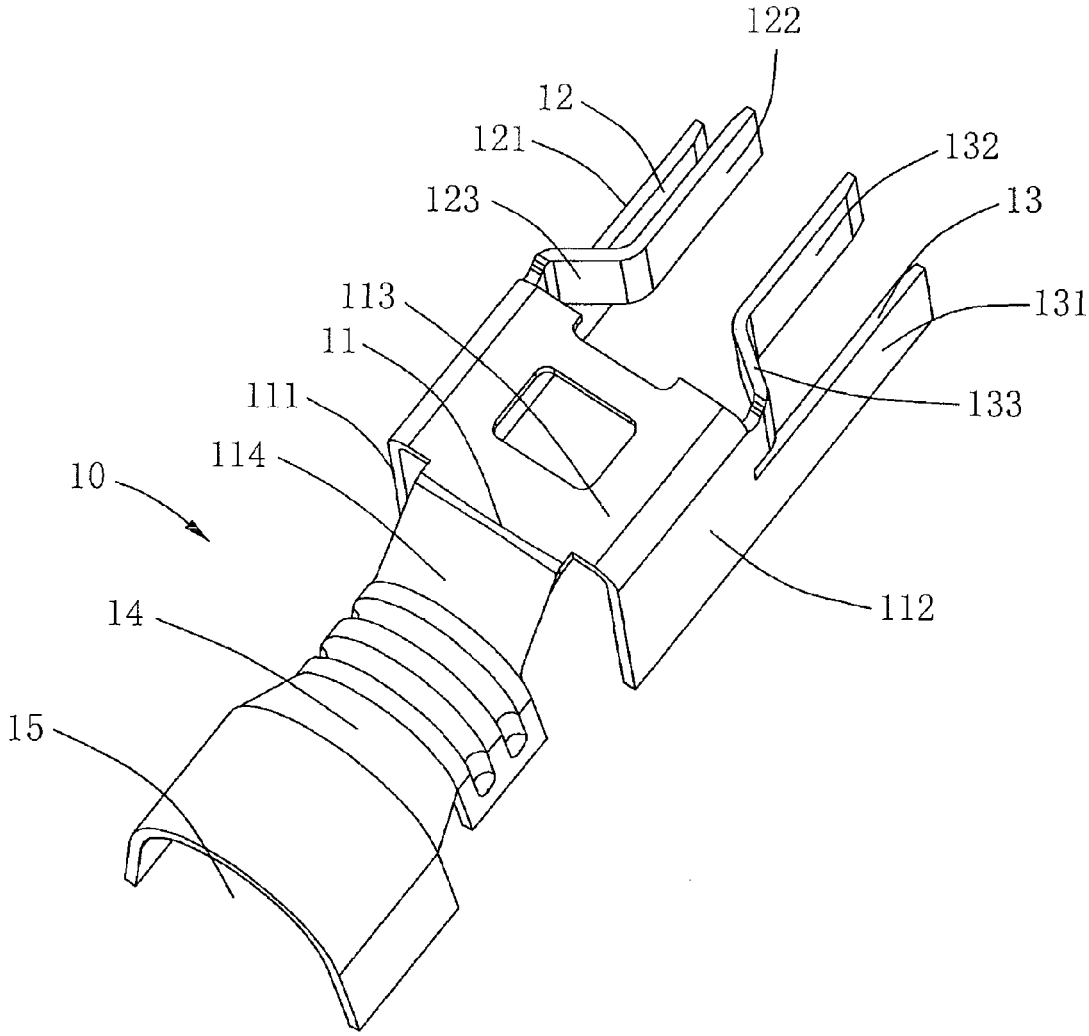
FIG. 11 is a view similar to FIG. 10 while taken from another aspect.

Turn to FIGS. 10-11, each power contact 10 comprises a base section 11, a first contact section 12 and a second contact section 13 extending forwards from the base section 11, a front retention section 14 extending rearwards from the base section 11 and a rear retention section 15 connecting with the front retention section 14. The base section 11 includes a first side wall 111, a second side wall 112 and a bottom wall 113 connecting the first side wall 111 and the second side wall 112. The two side walls 111, 112 extend perpendicularly to the bottom wall 113. The first contact section 12 is received in the first receiving passageway 211 and the second contact section 13 is received in the second receiving passageway 212.

The first contact section 12 comprises a first contact arm 121 projecting from the first side wall 111 and a second contact arm 122 extending parallel to the first contact arm 121. The first contact arm 121 and the first side wall 111 are in a same plane. The first contact section 12 has a connecting portion 123 interconnecting the first contact arm 121 and the second contact arm 122. The first contact arm 121 and the second contact arm 122 are positioned at different levels with respect to a thickness direction of the power connector 100. The second contact section 13 comprises a third contact arm 131 projecting from the second side wall 112 and a fourth contact arm 132 extending parallel to the third contact arm 131. The third contact arm 131 and the second side wall 112 are in a same plane. The second contact section 13 has a connecting portion 133 interconnecting the third contact arm 131 and the fourth contact arm 132. The third contact arm 131 and the fourth contact arm 132 are positioned at different levels with respect to a thickness direction of the power connector 100. In the preferred embodiment, a distance between the first contact arm 121 and the third contact arm 131 is larger than that between the second contact arm 122 and the fourth contact arm 132. Specially, in this preferred embodiment, a width of the first contact arm 121 and the second contact arm 122 is equal to that of the first side wall 111 of the base section 11. Similarly, the width of the third contact arm 131 and the fourth contact arm 132 is equal to that of the second side wall 112 of the base section 11.

The front retention section 14 and the rear retention section 15 are electrically and mechanically connecting to the cable. The contact 10 further comprises a slanted portion 114 slantedly connecting the base section 11 with the front retention section 14. In the preferred embodiment, the contact 10 of the present invention is stamped from one piece of metal sheet.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A power connector, adapted for electrically connecting a cable with a complementary connector, comprising:

an insulative housing defining at least one passageway, said at least one passageway including a first receiving passageway and a second receiving passageway; and at least one contact, said at least one contact received in said at least one passageway and having a base section, a first contact section and a second contact section, said base section comprising a bottom wall and a first side wall and a second side wall extending perpendicularly from said bottom wall, said first contact section comprising a first contact arm and a second contact arm parallel to said first contact arm, said second contact section comprising a third contact arm and a fourth contact arm parallel to said third contact arm, wherein a distance between said first contact arm and said third contact arm is larger than a distance between said second contact arm and said fourth contact arm.

2. The power connector as claimed in claim 1, wherein said first contact arm and said first side wall are located on a same plane.

3. The power connector as claimed in claim 2, wherein said third contact arm and said second side wall are located on a same plane.

4. The power connector as claimed in claim 1, wherein said first contact section has a connecting portion interconnecting said first contact arm and said second contact arm, and wherein said first contact arm and said second contact arm are positioned at different levels with respect to a thickness direction of the power connector.

5. The power connector as claimed in claim 4, wherein said second contact section has a connecting portion interconnecting said third contact arm and said fourth contact arm, and wherein said third contact arm and said fourth contact arm are positioned at different levels with respect to a thickness direction of the power connector.

6. The power connector as claimed in claim 5, wherein a width of said first contact arm and said second contact arm is equal to that of said first side wall of said at least one contact.

7. The power connector as claimed in claim 6, wherein a width of said third contact arm and said fourth contact arm is equal to that of said second side wall of said at least one contact.

8. The power connector as claimed in claim 1, wherein said at least one contact has a front retention section connecting with said base section and a rear retention section connecting with said front retention section.

9. The power connector as claimed in claim 8, wherein said at least one contact has a slanted portion slantedly interconnecting said front retention section and said base section.

10. The power connector as claimed in claim 1, wherein said at least one contact is stamped from one piece of metal sheet.

11. The power connector as claimed in claim 1, further comprising a metal shell covering said insulative housing and said at least one contact.

12. The power connector as claimed in claim 11, wherein one of said insulative housing and said metal shell defines a groove, and the other one of said insulative housing and said metal shell defines a protrusion, and wherein said groove engages with said protrusion to secure said insulative housing to said metal shell.

13. The power connector as claimed in claim 11, wherein said metal shell has an upper shield and a lower shield locked with said upper shield.

14. The power connector as claimed in claim 13, wherein one of said upper shield and said lower shield defines a cutout and the other one forms a hook portion engaging with said cutout to thereby connecting said upper shield with said lower shield.

15. The power connector as claimed in claim 14, wherein said metal shell defines a cable receiving hole for said cable extending therethrough, and wherein said cable receiving hole is composed by an upper hole defined in said upper shield and a lower hole defined in said lower shield.

16. The power connector as claimed in claim 11, wherein said metal shell defines a latch thereon.

17. The power connector as claimed in claim 16, wherein said insulative housing defines a recess for partially receiving said latch of said metal shell.

18. The power connector as claimed in claim 11, further comprising an anti-misplugging element received in said insulative housing for aligning the engagement between the power connector and the complementary connector.

19. The power connector as claimed in claim 18, wherein the insulative housing defines a key receiving hole for receiving the anti-misplugging element.

20. A power connector, adapted for electrically connecting a cable with a complementary connector, comprising:

an insulative housing defining at least one passageway, said at least one passageway including a first receiving passageway and a second receiving passageway; and at least one contact, said at least one contact received in said at least one passageway and having a base section, a first contact section and a second contact section, said base section comprising a bottom wall and a first side wall and a second side wall extending perpendicularly from said bottom wall, said first contact section comprising a first contact arm and a second contact arm parallel to said first contact arm, said second contact section comprising a third contact arm and a fourth contact arm parallel to said third contact arm; wherein said at least one contact has a front retention section connecting with said base section and a rear retention section connecting with said front retention section.

* * * * *